United States Patent [19]

Schillinger et al.

[11] 4,456,436

[45] Jun. 26, 1984

[54] ROTARY FUEL SUPPLY UNIT WITH MATCHED MATERIALS FOR THE ROLLERS AND RUNNING TRACK

[75] Inventors: Rainer Schillinger, Stuttgart; Karl Ruhl, Gerlingen; Ulrich Kemmner, Sachsenheim; Hans Schüler, Kornwestheim, all of Fed. Rep. of Germany

[73] Assignee: Robert Bosch GmbH, Stuttgart, Fed. Rep. of Germany

[21] Appl. No.: 487,601

[22] Filed: Apr. 29, 1983

Related U.S. Application Data

[63] Continuation of Ser. No. 47,443, Jun. 11, 1979, abandoned, which is a continuation-in-part of Ser. No. 823,780, Aug. 11, 1977, abandoned.

[30] Foreign Application Priority Data

Aug. 24, 1976 [DE] Fed. Rep. of Germany ..... 2637980

[51] Int. Cl.[3] ..... F04B 17/00; F04C 2/00; F04C 15/00; B32B 27/06

[52] U.S. Cl. ..... 417/366; 418/152; 418/178; 418/179; 418/225; 428/473.5

[58] Field of Search ..... 418/152, 178, 179, 225; 417/366; 428/473.5, 422

[56] References Cited

U.S. PATENT DOCUMENTS

| | | | |
|---|---|---|---|
| 2,424,466 | 7/1947 | Jessop | 418/225 |
| 2,776,625 | 1/1957 | Cook et al. | 418/225 |
| 2,818,024 | 12/1957 | Herschel | 418/179 |
| 3,084,632 | 4/1963 | Wintercorn | 418/225 |
| 3,131,643 | 5/1964 | Marietta | 418/178 |
| 3,191,852 | 6/1965 | Kaatz et al. | 418/179 |
| 3,460,481 | 8/1969 | White, Jr. | 418/178 |
| 3,470,791 | 10/1969 | Ovretveit | 418/152 |
| 3,542,498 | 11/1970 | Sadler | 418/225 |
| 3,803,075 | 4/1974 | Kray et al. | 428/473.5 |
| 3,969,044 | 7/1976 | Fussner et al. | 417/366 |

FOREIGN PATENT DOCUMENTS

| | | | |
|---|---|---|---|
| 2263637 | 7/1974 | Fed. Rep. of Germany | 418/178 |
| 2155238 | 5/1973 | France | 418/178 |
| 443941 | 3/1936 | United Kingdom | 418/225 |
| 534092 | 2/1941 | United Kingdom | 418/178 |
| 912793 | 12/1962 | United Kingdom | 428/422 |

*Primary Examiner*—John J. Vrablik
*Attorney, Agent, or Firm*—Edwin E. Greigg

[57] ABSTRACT

A fuel supply unit including a pump rotor and electromotor in which the elements forming the pump rotor are constructed from a non-friction creating or low wearing material.

4 Claims, 5 Drawing Figures

Fig. 2
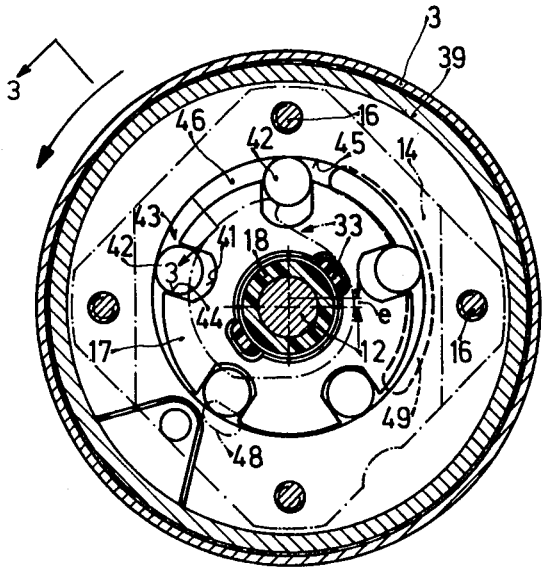
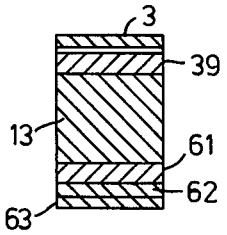
Fig. 3
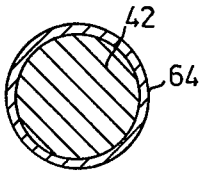
Fig. 4
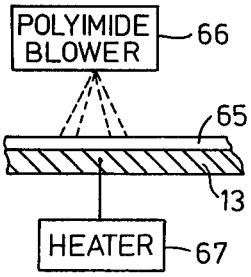
Fig. 3a

ROTARY FUEL SUPPLY UNIT WITH MATCHED MATERIALS FOR THE ROLLERS AND RUNNING TRACK

This is a continuation of application Ser. No. 047,443, filed June 11, 1979, (abandoned) which is a continuation-in-part of application of Ser. No. 823,780 filed Aug. 11, 1977 (abandoned).

BACKGROUND OF THE INVENTION

This invention relates to fuel supply pumps which include a pump rotor and a motor armature assembly, all of which are associated with an axially extending shaft. Adjacent to the electromotor at one end of a housing are mounted two spaced plates between which is mounted a further plate which forms part of the pump assembly. A pump rotor cooperates with the last named plate and, as known, is mounted eccentrically therein and upon rotation thereof serves to feed the fuel from the pump over an electromotor to cool the same while on its path of travel to the internal combustion engine.

Fuel supply units of the known type tent to wear out because of the continuous rotary movement of the rotor elements in the trackway they must follow to perform the function of a pump. This wear is detrimental to pump operation and causes an increase in current consumption as well as a decrease in revolution frequency, quantity of fuel supplied and consequently a reduction in the system pressure, all of which eventually leads to a failure in the fuel supply for the internal combustion engine.

OBJECT AND SUMMARY OF THE INVENTION

The primary object of the invention is to provide a rotary pump construction, the functioning elements of which are constructed of complemental materials which even when the pump has run dry from lack of fuel will not exhibit wear.

Another object of the invention is to provide a chromium plated trackway for the pump rotors.

Still another object of the invention is to use materials of different coefficients of hardness for the pump elements.

A further object of the invention is to provide a pump constructon which even after extensive operation is shown to consume only a very slightly increased amount of current.

These and other objects and advantages of the present invention will be more readily apparent from a further consideration of the following detailed description of the drawing illustrating a preferred embodiment of the invention, in which:

BRIEF DESCRIPTION OF THE DRAWING

FIG. 2 is a section along the line II—II in FIG. 1; and

FIG. 3 is a sectional view taken substantially along line 3—3 of FIG. 2 in the direction of the arrows.

FIG. 3*a* depicts application of a protective coating to the intermediate plate of the present invention.

FIG. 4 depicts a cut-away view of a plated roller.

DESCRIPTION OF THE PREFERRED EMBODIMENT

Figure 1:
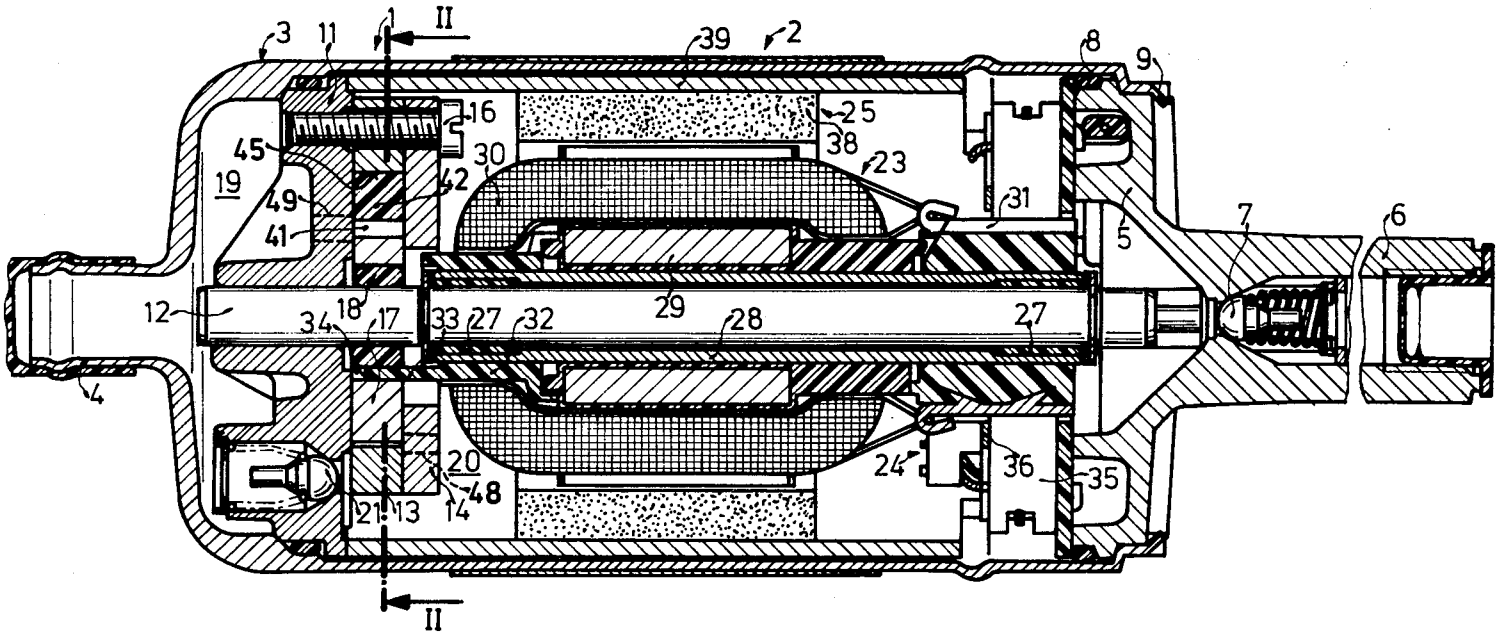
FIG. 1 is a longitudinal sectional view through the fuel supply unit according to the invention.

Turning now to the drawing, there are shown a fuel pump 1 and an electric motor 2 which are conjoined in the aggregate unit. These elements are housed in a cup-shaped housing 3 which comprises at one end a vacuum connection 4 for a fuel conduit, the other end of which is closed by a perforated cap 5, on which a pressure connection socket 6 and a non-return valve 7 that serves as a check valve, are mounted. A packing 8 is disposed between the housing 3 and the cap 5 as shown. The cap 5 is attached to the housing by means of bending prongs 9 provided on the open end of the housing 3.

In the housing 3 to the left as viewed in the drawing—from the suction side to the pressure side—the pump 1 is disposed and then the electromotor 2. The fuel supplied under pressure by the pump 1 flows around the electromotor 2 in a known manner so as to cool the same.

The pump 1 comprises a base plate 11, into the central bore of which one extremity of the shaft 12 is press-fitted. An intermediate plate 13 encompasses the pump rotor and supporting plate 14 supported on said base plate is disposed axially adjacent to the base plate 11 in abutment with the pump rotor by screws 16. The pump 1 communicates with the chamber 19 via openings on its suction side (not shown) and further includes a pressure control valve 21. The chamber 19 is confined to the end wall of the housing 3 and the base plate 11. The pressure side of the pump 1 extends to a chamber 20 which contains the electromotor 2 and communicates with the check valve 7. The connections from the pump 1 to the chambers 19 and 20 are controlled by the pump rotor but are preferably open channels.

The electomotor 2 comprises a motor armature 23, a collector 24 and a magnetic part 25.

The motor armature 23 is supported on a rigid tubular member 28 that telescopes the shaft 12 and is provided at opposite ends thereof with journal bearings 27. As shown this tubular member provides support for the motor armature and its requisite components including the commutator bushing 31. To assemble these elements they are attached partly by pressure and partly by means of plastic filler means which, after spraying of the individual elements, ensure a good rotation-locking axial connection.

A bushing 32 or sleeve of this invention is disposed on the telescoping tubular member 28 on the side that confronts the pump and engages in the manner of a rotating coupling comprising at least one axially extending tang 33 which is received in a corresponding recess 34 in the rotor 17.

The commutator brushes 35, which are disposed in cage elements 36, are arranged to slide on the commutator bush 31. The cage elements 36 are connected with connection clamps (not shown) that are disposed outside the housing 3.

The magnetic parts 25 of the electromotor 2 includes a permanent magnet 38 which is disposed in a tubular sheet 39 made of a magnetically conducting material.

As seen in FIG. 2 grooves 41 are arranged in the pump rotor 17, and in these grooves are disposed radially movable rollers 42 which serve as the pumping elements. The rollers 42 are guided along the surface of the bore 43 in which they are located by the parallel sides of the grooves as well as by the end walls of base plate 11 and the supporting plate 14. Because of centrifugal force the rollers 42 are pressed outwardly into a course of movement against the intermediate plate 13. The intermediate plate 13 and the pump rotor are offset relative to the shaft 12, eccentrically by the factor "e".

Thus, because of this eccentricity, a crescent-shaped pumping space 46 is formed adjacent to the rollers 42 when the pump is driving in the direction shown by the arrow. It will be apparent that this pumping space 46, which is provided between two of the rollers 42, becomes smaller during operation whereby the fuel in that space comes under sufficient pressure that it is caused to be pushed through a pressure opening 48 into the space 20 of the fuel pump. (See FIG. 1) Fuel enters the pump chamber 46 from chamber 19 through a kidney-shaped suction opening 49, which as shown, covers a large area of the pumping space as long as the crescent shape is enlarging with regard to the specific roller in question.

In order to keep the wear on the running surface as well as on the rollers themselves at a minimum, especially during dry operation, the following matings of construction materials were discovered. Although the pairings of materials is surprising to the specialist, the test results are extremely positive. The pairings are surprising because materials with completely different coefficients of hardness are used. It has been found that the surface of the track for the rollers can be chromium plated or it can be coated with polyimide lacquer or with polyester imide lacquer. Success has also been had where the track is sealed in polyimide foil. Further as shown best in FIG. 3 the track can be built as a multilayered or composite bushing 61, for example, a composite bushing that is made out of steel coated with epoxy resin or having a steel-tin bronze layer 62, which is saturated with a PTFE lubricant coating 63. Also, the intermediate plate 13 can be composed of aluminum and the track 45 would be an oxidized surface such as an anodic or oxide layer having a hard coat. The intermediate plate 13 can also consist of a phenol resin laminated fabric. It is also possible, if for example the intermediate plate 13 is made of steel, that the polyimide surface on which the rollers travel could be sintered or pressed in the form of a ring. With a polyimide it is especially advantageous to provide for graphite fillings to reduce friction. The sintered polyimide may be applied by blowing the polymide onto the heated running track of the intermediate plate as indicated in FIG. 3*a*. The polyimide 65 is blown by blower 66 onto intermediate plate 13, which is heated by heater 67.

The following materials can also be used on the surface of the rollers 42. For example, the roller can be chromium or nickel plated, or alloyed with boron. See 64 of FIG. 4. It can also consist of aluminum with an oxidized surface such as an anodic or oxide layer. However, it can also be of polyimide with or without a graphite filling at which time a metal core would be used, in order to maintain the necessary strength for the centrifugal thrust. In addition, the roller can also be made of ceramic or of artificial carbons, such as CuPb-graphite.

Every one of the materials hereinbefore referred to for the surface on which the rollers travel is suitable for pairing with every material indicated for the roller, in order to achieve the advantages mentioned earlier herein.

The foregoing relates to a preferred exemplary embodiment of the invention, it being understood that other embodiments and variants thereof are possible within the spirit and scope of the invention, the latter being defined by the appended claims.

What is claimed is:

1. In a fuel supply unit comprising a pump and an electromotor, the pump including: two stationary side plates; an intermediate plate; a pump rotor, the intermediate plate being situated eccentrically with regard to the pump rotor, said intermediate plate having a running track defining a circular clearance within which the rotor is located, with the clearance between the rotor and the running track defining a crescent-shaped pumping space, said rotor having axially aligned grooves formed therein which open outwardly toward the running track of the intermediate plate; and a roller situated in each groove, each roller having a hardened coating on its rolling surface, said rollers being radially displaceable by centrifugal force into the pumping space in rolling contact with said running track, said running track being constructed as a multilayered bushing inserted within the circular clearance of the intermediate plate, said bushing consisting of an outer layer of steel, an intermediate layer of sintered metal impregnated with a synthetic resin, and an inner layer of said synthetic resin on which said rollers run.

2. The fuel supply unit as defined in claim 1, wherein said intermediate layer is of a sintered bronz composition and wherein said synthetic resin is PTFE.

3. The fuel supply unit as defined in claim 1, wherein said synthetic resin is a sintered polyimide.

4. A fuel supply unit comprising a pump and an electromotor, the pump including: two stationary side plates; an intermediate plate; a pump rotor, the intermediate plate being situated eccentrically with regard to the pump rotor and having a running track defining a circular clearance within which the rotor is located, with the clearance between the rotor and the running track defining a crescent-shaped pumping space, said rotor having grooves formed therein which open outwardly toward the running track of the intermediate plate; and a roller situated in each groove, each roller being formed of steel having a chromium plated outer surface on its rolling surface, displaceable by centrifugal force into the pumping space, said running track being constructed as a multilayered bushing having an outer layer of steel, an intermediate layer of sintered metal and an inner layer of synthetic resin on which said rollers run.

* * * * *